United States Patent [19]

Lydmar

[11] 4,206,956

[45] Jun. 10, 1980

[54] KNOCK-DOWN CUPBOARD ASSEMBLY

[75] Inventor: Arne Lydmar, Bromma, Sweden

[73] Assignee: Ingenjorsfirma Eifa AB, Vallingby, Sweden

[21] Appl. No.: 949,023

[22] Filed: Oct. 6, 1978

[30] Foreign Application Priority Data

Oct. 12, 1977 [SE] Sweden ..... 7711454

[51] Int. Cl.[2] ..... A47B 43/00

[52] U.S. Cl. ..... 312/257 SK; 312/257 A; 312/111; 312/140

[58] Field of Search ..... 312/257 SK, 257 R, 257 A, 312/257 SM, 140, 140.4, 111

[56] References Cited

U.S. PATENT DOCUMENTS

| | | | |
|---|---|---|---|
| 1,374,868 | 4/1921 | White | 312/257 SK |
| 2,730,421 | 1/1956 | Burst et al. | 312/257 SK |
| 2,991,140 | 7/1961 | Anderson et al. | 312/257 SK |
| 3,061,395 | 10/1962 | Marateck et al. | 312/257 SK |
| 3,110,535 | 11/1963 | Anderson | 312/257 SK |
| 3,265,419 | 8/1966 | Durnbaugh et al. | 312/257 SK |
| 3,738,726 | 6/1973 | Burst et al. | 312/257 SK |
| 3,869,183 | 3/1975 | Frank, Jr. | 312/226 |
| 3,883,196 | 5/1975 | Mohr et al. | 312/111 |
| 4,103,981 | 8/1978 | Donahue et al. | 312/257 A |

FOREIGN PATENT DOCUMENTS

| | | | |
|---|---|---|---|
| 1164735 | 10/1958 | France | 312/257 SK |
| 8720 | 3/1911 | United Kingdom | 312/140 |

*Primary Examiner*—Victor N. Sakran

*Attorney, Agent, or Firm*—Haseltine, Lake & Waters

[57] ABSTRACT

A knock-down cupboard assembly having a rear wall, two pairs of side walls and a door, the door being removably mounted on a frame, the frame having two opposing sides each being formed by two vertical corner posts having spaced horizontal glide rails fastened thereto, wherein: The rear wall is provided with retaining brackets for engagement with the frame and one of the pair of side walls being provided with a number of retaining brackets for engaging against an inside of a third corner post, and the other pair of side walls being provided with retaining fittings for engaging an inside of the remaining corner post.

2 Claims, 6 Drawing Figures

KNOCK-DOWN CUPBOARD ASSEMBLY

BACKGROUND OF THE INVENTION

Figure 1:
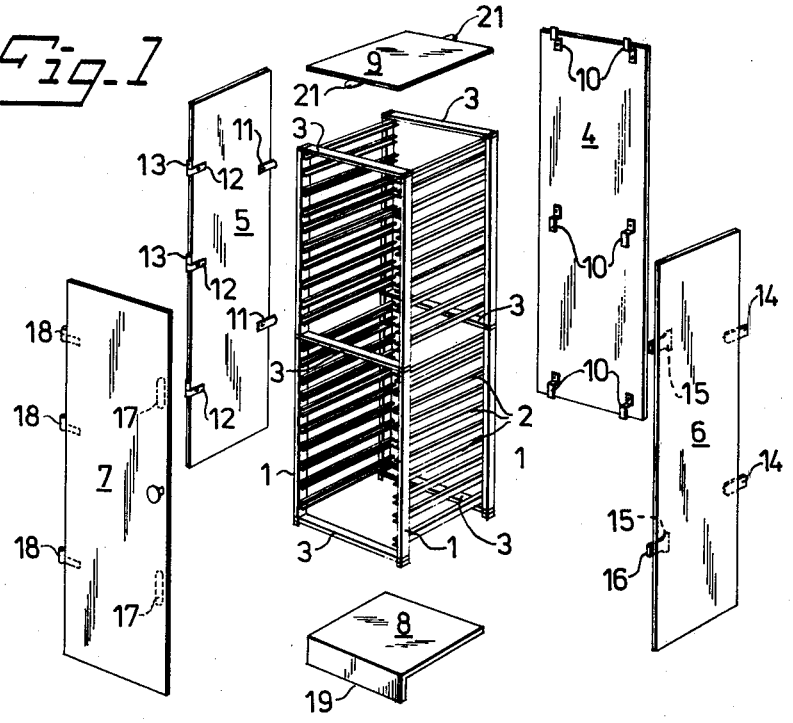

The present invention relates to a cupboard comprising a body portion and having on it removably fitted walls, a door and preferably a top and a bottom, enabling the parts of said cupboard to be sent from the place of manufacture to the place of use in a packed condition for subsequent easy assembly.

It has already been suggested to have a cupboard consist of assemblable walls, a door a top and a bottom, the cupboard parts being assemblable either directly to each other or to a frame. In the first alternative, it is required that the individual cupboard parts have a high degree of stiffness and solidity for attaching means, there means therefrom have to be of steel or the like, the parts also needing reinforcing rails, thus being given considerable weight. In the latter alternative, the body portion has consisted of complicated mutually rigidly connected frame members so that delivery is made more difficult, or it has consisted of assemblable members providing instability to the cupboard in an assembled state.

SUMMARY OF INVENTION

The object of present invention is to cupboard formed of a simple stable body member to which can be fitted assemblable walls, a door and preferably also a top and a bottom, in a simple way and with simple tools, e.g. a screwdriver.

This object is accomplished in that the walls and door as well as possible top and bottom of a cupboard are removably fitted to a conventional body portion, rectangular in plan, the opposing sides being each formed from two vertical corner posts to which there are attached spaced horizontal glide rails, its remaining two opposing sides being formed by at least lower and upper horizontal cross struts removably mounted between the corner posts of the first-mentioned sides.

According to the present invention, the rear wall of the cupboard is provided with joggled brackets on its inside for engagement with lower and upper cross struts at the rear side of the carcass, and at one long edge each side wall is preferably provided with two turn buttons for engagement with a rear corner post, one side wall being preferably provided at its other long edge with three retainer plates for engagement with a forward corner post, each plate also carrying a hinge half, and that the other side wall at its other long edge is preferably provided with two retainer plates, each with a lock portion or permanent magnet, and the door is preferably provided with three hinge halves for coaction with the hinge halves on the one side wall and provided with locking parts or magnetically actuable stops for coaction with the locking parts or magnets on the other side wall.

IN THE DRAWINGS

Figure 2:
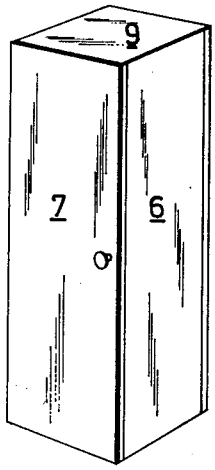
Figure 3:
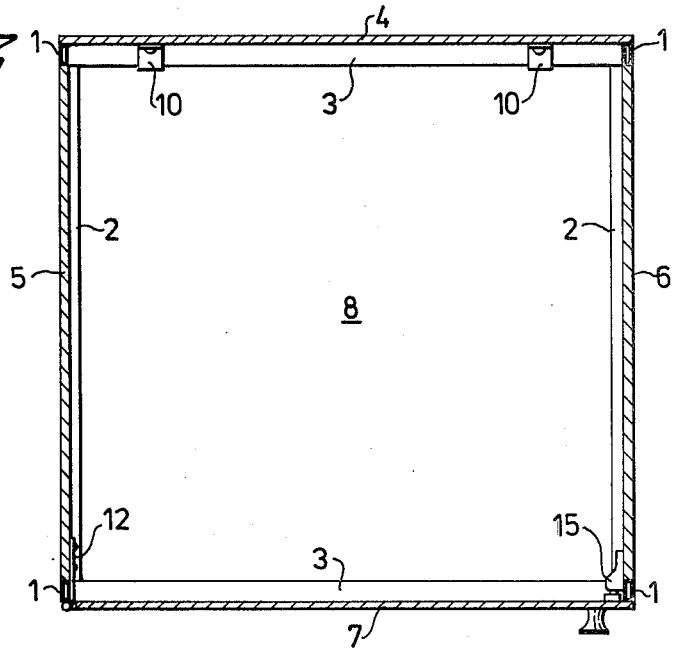
Figure 4:
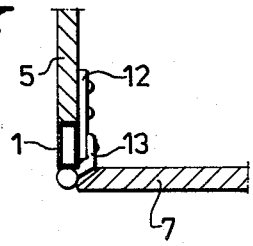
Figure 5:
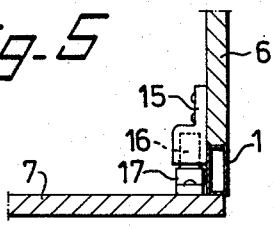
Figure 6:
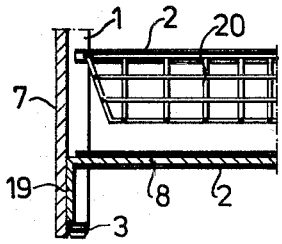

The invention is illustrated by an embodiment shown on the attached drawing as an example, where FIG. 1 shows an exploded perspective view of the cupboard parts FIG. 2 shows an outside perspective view of the cupboard according to the invention FIG. 3 shows to a larger scale the horizontal section through the cupboard FIGS. 4 and 5, to an even larger scale and in horizontal section, show parts of a pair of corners of the cupboard, and FIG. 6 shows a vertical section of a part of the lower portion of the cupboard.

DESCRIPTION OF THE INVENTION

In the known body portion shown in FIG. 1, two opposing sides are each formed from two vertical corner posts 1 made from square tubes, there being U-shaped glide rails 2 attached to their opposing sides. The remaining two opposing sides are formed by cross struts 3, joined to the corner posts 1 downwardly, at the middle and upwardly, such that on their ends, the struts have attachment brackets removably fitted into the tubular corner posts 1. FIG. 1 shows that each of the body portion sides formed by corner posts and glide rails consists of two parts, one above the other, connected by the attachment brackets of the cross strut 3 fitted into the corner posts, but each body portion side can instead be in one piece, thus without the middle cross piece. The body portion 1–3 is completely stable in an assembled condition.

A rear wall 4, two side walls 5 and 6, a door 7, a bottom 8 and a top 9 are formed of relatively light flat sheets, such as fiberboard, since they do not need to stiffen the stable body portion 1–3.

The inside of the rear wall 4 provided with two joggled brackets 10 is downwardly, at the middle and upwardly, each is attached to the rear wall by means of a screw for gripping round the respective cross strut 3. As shown in FIG. 3, the rear wall 4 abuts against both the corner posts 1 and cross strut 3.

Both side walls 5, 6 are placed between respective corner posts 1 as shown in FIG. 3, and against the outer side of the glide rails 2. On its inside, one side wall 5 is provided along one long edge with a pair of turn buttons 11, for engagement with rear corner post, and at its other long edge is provided with three retainer or anchor plates 12, projecting past the long edge for engagement against a front corner post as shown in FIG. 4, to anchor the side wall to the body portion. Each plate 12 carries a hinge half 13.

On its inside, the second side wall 6 similarly has turn buttons 4 along one long edge, for engagement with a rear corner post 1, and is provided along its other long edge with two fittings 15 extending past the long edge for engagement against a front corner post as shown in FIG. 5, for anchoring the side wall 6 to the carcass 1–3. Each fitting 15 carries a permanent magnet 16, and on the inside of the door 7 there are attached pads 17 of iron or magnetic material, for coaction with the magnets 16. The door 7 also carries three hinge halves 18 for coaction with the hinge halves 13 of the side wall 5.

The sheet-like bottom 8 is insertable in the lower pair of U-shaped glide rails 2 as shown in FIG. 6, and is provided with a downwardly projecting threshold 19. FIG. 6 also shows a drawer 20 suspended and movable on a pair of glide rails 2.

The sheet-like top 9 rests removably on the upper cross struts 3 and is anchored to these by means of at least one pair of fastening plates 21.

The described cupboard has the advantage that its parts can easily be packed and dispatched in a dismantled condition, and futhermore, without special instructions, can be conveniently put together into a stable cupboard by first assembling the body portion 1–3, and thereafter the rear wall, by means of the brackets 10.

The retainer plates 12 of the side wall 5 are slid against the inward side of the front corner post concerned, whereafter the side wall is fitted in between the front and rear corner posts against the glide rails 3, and in anchored in this position by the turn buttons 11 being brought to bear against the inside of rear corner post. The fittings 15 of the other side wall 6 are pushed over the inside of the appropriate forward corner post, whereafter the side wall 6 is fitted in between the front and rear corner posts against the glide rails 3 and is anchored by turning the turn buttons 14 to bear against the rear corner post. Since it is not required that the walls 5–6 shall stiffen the body portion, they are easily fitted in their places.

The bottom 8 is subsequently inserted, the top 9 is put in place and the door 7 is hooked on, it being held in a closed position by means of the magnetic locks 16, 17. The glide rails of the cupboard can carry basket-like drawers, flat shelf boards or carriers formed in some other way, e.g. a transverse bar at a suitable height for clothes hangers etc.

The invention is not to be regarded as limited solely to the embodiment described and shown on the drawing, since this may be modified within the purview of the invention. For example, top, bottom and intermediate brackets on the rear wall can be dispensed with. The details of the body portion, especially the glide rails, can be modified, and the number of turn buttons, brackets and fittings can be varied. The door-closing details can also have a modified design.

I claim:

1. A cupboard having a rear wall, side walls and a door, said door being removably mounted on a frame, said frame is foursided in plan, having two opposing sides each being formed by two vertical corner posts having spaced horizontal glide rails fastened thereto and two opposing sides of said frame being formed by at least lower and upper horizontal cross struts removably fitted between corner posts of said two opposing sides, wherein: a rear wall of said cupboard is provided on its inside surface with retaining brackets for engagement with the lower and upper struts at one side of the frame, and a pair of walls on their inside are each provided adjacent one vertical edge, with means for engagement with an inside of a respective corner post adjacent said rear wall, one of said pair of side wall being provided with a number of retaining brackets proximate to its edge opposite said one edge each carrying a hinge part and engaging against an inside of a third corner post, and the other of said pair of side walls being provided with at least one retaining fitting proximate to its edge opposite said one edge for engaging an inside of the remaining corner post, each retaining fitting having a magnetic means for maintaining the door in its closed position, the door is provided with hinge parts for coaction with the hinge parts on said one side wall and with pad means of magnetizable material, arranged to cooperate with said means on the other side wall to maintain the door releasably in its closed position.

2. A cupboard as claimed in claim 1, wherein: a bottom is provided with a forward projecting edge, said bottom being insertable on the lowest pair of glide rails in the frame so that said edge can be placed in a position inside the cupboard behind the door when the latter is in its closed position.

* * * * *